US007152890B2

(12) United States Patent
Torkowski et al.

(10) Patent No.: US 7,152,890 B2
(45) Date of Patent: Dec. 26, 2006

(54) POWER-OPEN MOTOR-VEHICLE LATCH

(75) Inventors: Thorsten Torkowski, Duisburg (DE); John Dey, Wixom, MI (US)

(73) Assignee: Kiekert AG, Heiligenhaus (DE)

( * ) Notice: Subject to any disclaimer, the term of this patent is extended or adjusted under 35 U.S.C. 154(b) by 78 days.

(21) Appl. No.: 10/932,877

(22) Filed: Sep. 2, 2004

(65) Prior Publication Data

US 2006/0043740 A1 Mar. 2, 2006

(51) Int. Cl.
*E05C 3/06* (2006.01)

(52) U.S. Cl. ..... 292/216; 292/201; 292/DIG. 23

(58) Field of Classification Search ..... 292/216, 292/201, DIG. 23, 199, 280
See application file for complete search history.

(56) References Cited

U.S. PATENT DOCUMENTS

| | | | | |
|---|---|---|---|---|
| 5,802,894 | A * | 9/1998 | Jahrsetz et al. | 70/264 |
| 5,934,717 | A * | 8/1999 | Wirths et al. | 292/201 |
| 5,938,253 | A * | 8/1999 | Szablewski et al. | 292/216 |
| 6,056,334 | A * | 5/2000 | Petzold et al. | 292/216 |
| 6,155,124 | A * | 12/2000 | Wirths | 74/89.13 |
| 6,279,361 | B1 * | 8/2001 | Baukholt et al. | 70/279.1 |
| 6,386,599 | B1 * | 5/2002 | Chevalier | 292/201 |
| 6,390,517 | B1 * | 5/2002 | Ehret | 292/201 |
| 6,419,286 | B1 * | 7/2002 | Szablewski | 292/216 |
| 6,435,573 | B1 * | 8/2002 | Szablewski | 292/201 |
| 6,439,623 | B1 * | 8/2002 | Lohfeld et al. | 292/201 |
| 6,474,704 | B1 * | 11/2002 | Rathmann et al. | 292/201 |
| 6,557,911 | B1 | 5/2003 | Nelsen | |
| 6,565,131 | B1 * | 5/2003 | Roos | 292/201 |
| 2004/0113438 | A1 | 6/2004 | Kachouh | |
| 2005/0146144 | A1 * | 7/2005 | Brose | 292/201 |

FOREIGN PATENT DOCUMENTS

| | | |
|---|---|---|
| DE | 297 01 390 | 11/1997 |
| DE | 10222374 | 12/2003 |
| DE | 10234782 | 2/2004 |

* cited by examiner

*Primary Examiner*—Brian E. Glessner
*Assistant Examiner*—Carlos Lugo
(74) *Attorney, Agent, or Firm*—Andrew Wilford

(57) ABSTRACT

A motor-vehicle door latch has a housing, a fork pivotal on the housing between a bolt-retaining closed position and a bolt-releasing open position, and a pawl pivotal on the housing between a blocking position engaging the fork and retaining it in the closed position and a freeing position allowing the fork to move into the open position. A wheel rotatable about a wheel axis has a radially directed cam surface engageable with the pawl. A drive rotates the wheel and thereby engages the surface with the pawl to displace the pawl into its freeing position. Interengaging formations on the pawl and on the wheel block rotation of the wheel when the pawl is in the freeing position.

10 Claims, 4 Drawing Sheets

POWER-OPEN MOTOR-VEHICLE LATCH

FIELD OF THE INVENTION

The present invention relates to a latch. More particularly this invention concerns a latch that is used in a motor vehicle to retain a door, seat back, or the like in position and that is operated by a motor.

BACKGROUND OF THE INVENTION

A power-open latch for a motor vehicle is known from parallel U.S. Pat. No. 6,577,911 and EP 1,225,290 which has a housing, a fork pivotal on the housing between a bolt-retaining closed position and a bolt-releasing open position, and a pawl pivotal on the housing between a blocking position engaging the fork and retaining it in the latched position and a freeing position allowing the fork to move into the unlatched position. A wheel rotatable about an axis has a radially directed cam surface on which rides a projection on the pawl. A drive motor can rotate the wheel and thereby engage its surface with the projection to displace the pawl into its freeing position. A spring is braced between the pawl and the housing and urges the pawl into the blocking position and the projection into engagement with the surface. Furthermore the wheel has a groove having a pair of ends, one radially directed flank formed by the cam surface, and an opposite radially directed flank forming another surface. The cam surface is formed as a spiral generally centered on the wheel axis and the other surface is generally centered on the wheel axis. The groove has a wide end and a narrow end.

The motor can rotate the wheel from a starting position with the pawl projection bearing on the low or radially inner end of its surface to an ending position with the pawl projection bearing on the high end of the wheel surface and hence in its freeing position to open the latch. When the motor is shut down in this ending position, a powerful torque spring reverse rotates the wheel back to the starting position allows the latch to close.

While this construction is fairly effective, has some problems. First of all the mechanism is somewhat complex. The return spring must be very strong to reverse-drive the motor. Furthermore with time the mechanism gets stiff so that the torque of the spring is not enough to reset the lock, or at least takes quite some time.

OBJECTS OF THE INVENTION

It is therefore an object of the present invention to provide an improved power-open motor-vehicle latch.

Another object is the provision of such an improved power-open motor-vehicle latch which overcomes the above-given disadvantages, that is which is of simple construction and operation.

SUMMARY OF THE INVENTION

A motor-vehicle door latch has according to the invention a housing, a fork pivotal on the housing between a bolt-retaining closed position and a bolt-releasing open position, and a pawl pivotal on the housing between a blocking position engaging the fork and retaining it in the closed position and a freeing position allowing the fork to move into the open position. A wheel rotatable about a wheel axis has a radially directed cam surface engageable with the pawl. A drive rotates the wheel and thereby engages the surface with the pawl to displace the pawl into its freeing position. Interengaging formations on the pawl and on the wheel block rotation of the wheel when the pawl is in the freeing position.

Thus with this invention the pawl serves to block the wheel and prevent it from rotating when this pawl is in its outer freeing position. It is only in this position in two circumstances, namely when the wheel surface has pushed it out into the freeing position/or when according to the invention in the open position of the fork interengaging formations on the pawl and fork engage each other and hold the pawl in the freeing position. Thus no return spring is needed, simplifying the structure and giving it better long-term reliability.

According to the invention the surface of the wheel is spiral shaped and has relative to the wheel axis a radially high end and a radially low end separated by an angularly directed step face. The low end is the starting position for rotation. The interengaging-blocking formations of the pawl and the wheel contact each other and block rotation of the wheel when the high end of the wheel surface is operatively bearing on the pawl. Relative to the wheel axis, the interengaging blocking formation of the wheel is an angularly directed blocking face fixed relative to, spaced angularly from, and directed angularly opposite to the step face.

The drive includes a motor for rotating the wheel the wheel axis only in one rotation direction. The step face is directed angularly backward in the rotation direction. Thus the drive is extremely simple, it merely be a one-way overload-protected motor. Once it is energized, it will operate until the wheel is blocked, whereupon it will shut itself off. This blocked condition will persist so long as the latch is open so that even if an attempt is made to energize the motor and operate the latch with, the latch open, the blocked wheel will prevent any such operation and the motor will immediately time out. After the latch is closed and the pawl is freed to drop back into the blocking position, the wheel itself is unblocked so that energizing the motor will initiate a new opening cycle.

Relative to the wheel axis according to the invention, the wheel surface is a radially outwardly directed spiral-shaped inner surface. The wheel has offset from the blocking face a radially inwardly directed outer edge surface that is generally circular and centered on the center of rotation of the wheel. These two wheel surfaces thereby are spaced apart by a radial distance that is the least at the high end of the inner surface.

A spring urges the pawl radially of the wheel axis inward against the wheel surface and another spring urges the fork into the open position. In addition the pawl has a coupling pin projecting generally parallel to the wheel axis and normally riding on the wheel surface.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
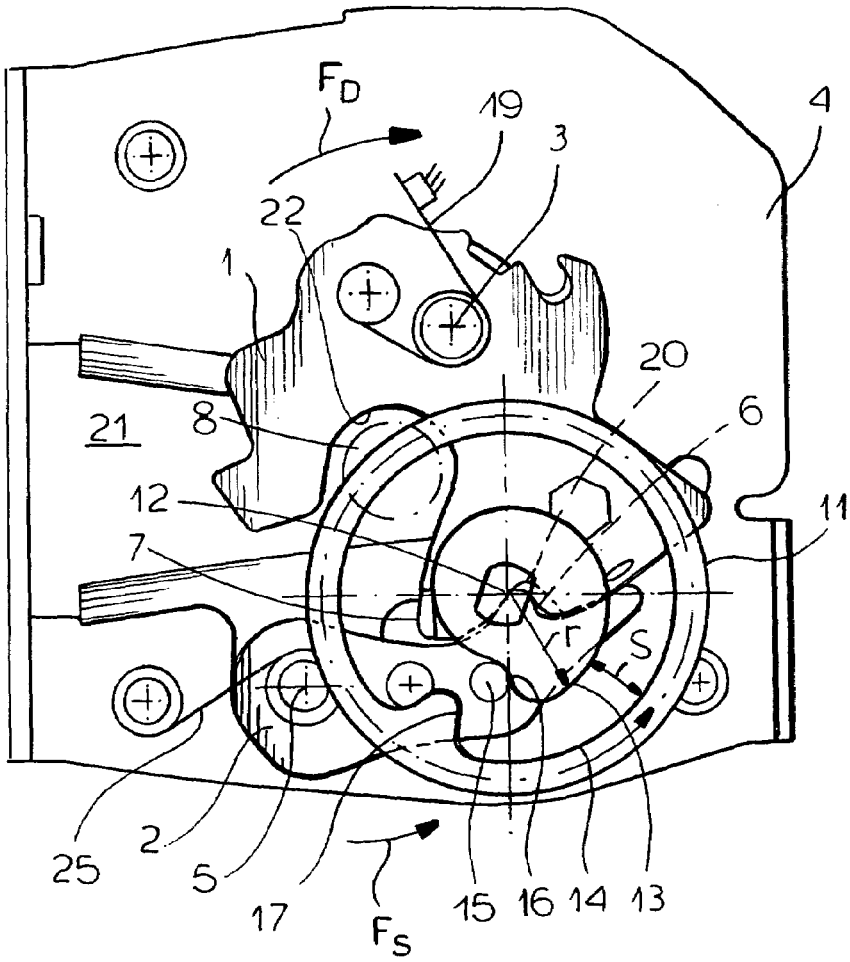
FIG. 1 is a side view of the latch in the partially latched or closed position.
Figure 2:
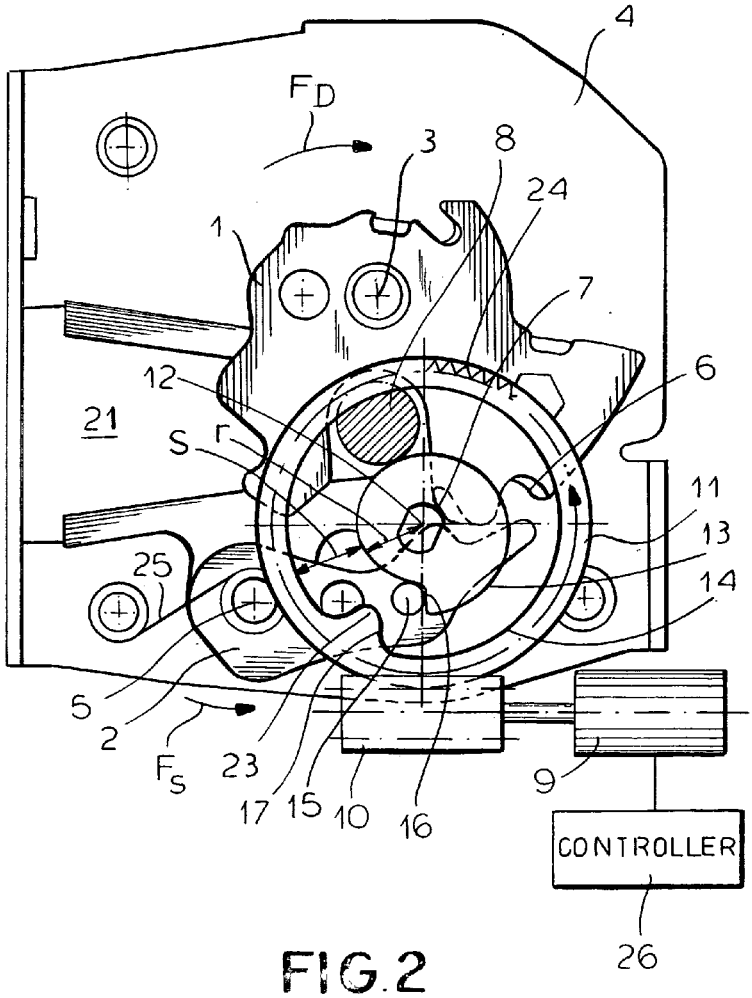
FIG. 2 is a side view of the latch in the fully latched or closed position.
Figure 3:
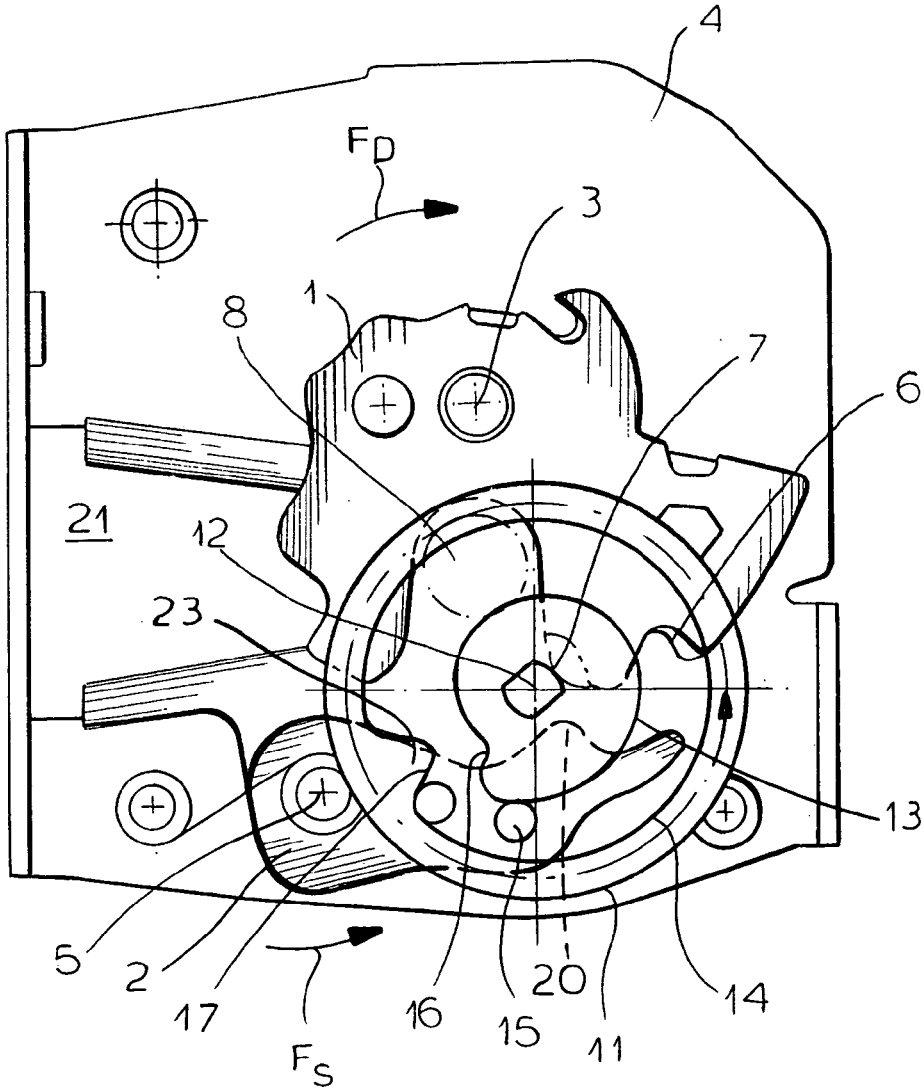
FIG. 3 is a side view of the latch as in FIG. 2, but with the latch paws in the freeing position.
Figure 4:
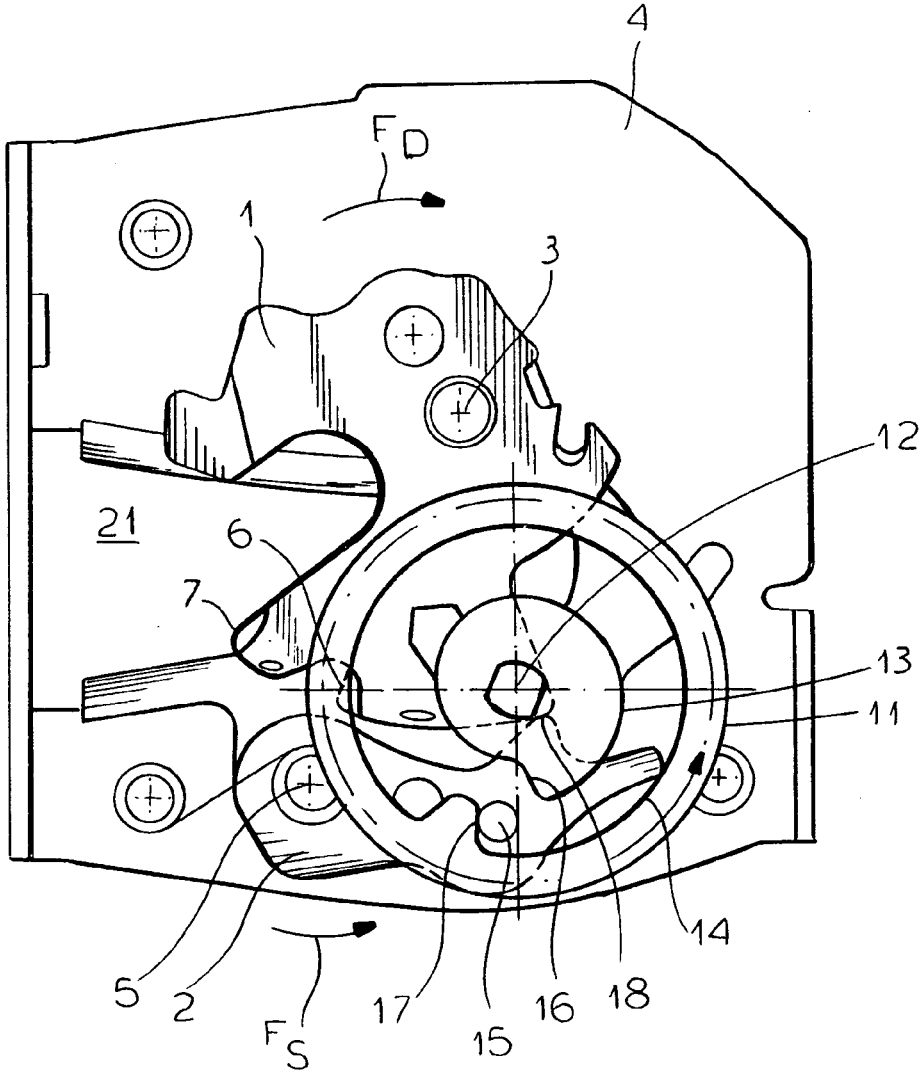
FIG. 4 is a side view of the latch in the open position.

As seen in FIGS. 1 and 2, a latch according to the invention has a housing 4 in which a standard latch fork 1 is pivotal about a horizontal axis 3 and is urged rotationally in a direction $F_D$ by a torque spring 19 from a fully closed position (FIGS. 2 and 3) through a partially closed position (FIG. 1) to a fully open position (FIG. 4). It has a pair of abutment faces 6 and 7 directed angularly in the direction $F_D$ and engageable with a retaining tooth 20 of a latch pawl 2 pivotal on the housing 4 about an axis 5 parallel to but offset from the axis 3 and urged rotationally in an opposite direction $F_S$ by another torque spring 25 like the spring 19 from an outer freeing position (FIGS. 3 and 4) toward an inner blocking position (FIGS. 1 and 2). Thus when the pawl 2 is in its blocking position it blocks the fork 1 from rotating under the force of its spring into the open position, but when in its freeing position permits such rotation.

This latch can be used to retain, for example, a folding rear seat back in the erect position or a vehicle door in the closed position. Its housing 4 is mounted completely out of sight on the vehicle frame and is formed with a notch 21 open radially of the axes 3 and 5 and shaped to receive a seat- or door-mounted bolt 8 that can be held in a mouth 22 of the fork 1 in the manner well known in the art. Thus, as is standard, when the seat is tipped back or the door is closed, the bolt 8 enters the notch 21 and fits into the mouth 22 when the fork 1 is in the open position shown in FIG. 4. Thereafter, on traveling inward (to the right in FIGS. 1–4) the bolt 8 will pivot the fork 1 counterclockwise opposite to the direction $F_D$ and against the force of the spring 19. This will cause the tooth 20 to first come to rest as shown in FIG. 1 against the abutment face 6 in a partially latched position and then, in a fully latched position, against the abutment face 7 of FIG. 2. Outward pivoting of the latch pawl 2 against the force of its spring 25 allows the spring 19 to pivot the fork 1 into the FIG. 4 open position and free the bolt 8.

According to the invention the pawl 2 can be moved against its biasing direction $F_S$ from the inner blocking position of FIGS. 1 and 2 in which it engages the faces 6 and 7 and blocks clockwise rotation of the fork 1 to the outer freeing position of FIGS. 3 and 4 by an actuating element constituted as a cam wheel 11 rotatable on the housing 4 about an axis 12 parallel to and generally between the axes 3 and 5. This cam wheel 11 hasten inner radially outwardly directed annular cam surface 13 that is spiral shaped with ends joined by an essentially radially extending abutment face 16 directed angularly against the direction $F_S$ and a radius r that varies smoothly to both sides of the face 16. The surface 13 here is shown as a spiral with a constant slope, but this slope could be varied by decreasing the slop at the low end to, for instance, apply more radially outwardly directed force at the start to ensure that even a tightly closed latch is opened.

An actuating pin 15 projecting axially from the pawl 2 is pressed radially inward toward the surface 13 by the action of the spring 25 on the pawl 2. The wheel 11 also has a radially inwardly directed circular surface 14 that is centered on the axis 12, that is spaced at a varying distance S outward from the surface 13, and that is formed with a radially inwardly projecting tooth 23 (FIGS. 2 and 3) having a face 17 projecting generally radially of the cain axis 12 in the direction $F_s$.

The spiral shape of the cam surface 13 of the wheel 11 is such that as it rotates through 360° it will displace the pawl 2 once between its blocking and freeing positions. More particularly, presuming rotation of the wheel in the direction $F_s$ from the starting position of FIG. 3, when the pin 15 drops off the high end of the surface 13 past the face 16 onto the low end of the face 16, the pawl 2 moves from the freeing to the blocking position. Thereafter, as the pin 15 is pushed radially outward by continued rotation of the wheel 11, the pawl 2 moves gradually from the blocking to the freeing position with the wheel returning to the FIG. 3 starting position and the pin 15 again bearing on the high end of the surface 13. In the partially and fully latched positions of FIGS. 1 and 2, respectively, the abutment face 17 is spaced counterclockwise from the face 16 by a distance equal to more than the diameter of the actuating pin 15 of the pawl 2.

The fork 1 has a part-spiral outer edge 18 that is engageable with the tooth 20 only in the FIG. 4 open position to hold the pawl 2 out in its freeing position. Thus as will be described below, so long as the latch is open, the pawl 2 is held back out of its way. Only when the fork 1 is forced back toward the closed positions against the force of its spring 19 will the edge surface 18 disengage from the pawl 2 and permit it to pivot back into the blocking position.

A drive motor 9 has a worm gear 10 meshing with teeth 24 formed on the outer surface of the wheel 11. This motor 9 can only rotate in one direction to turn the wheel 11 as indicated by the arrow in the direction $F_S$. It is operated by a controller 26 that turns it off if its current consumption exceeds a predetermined limit for a predetermined time.

This latch operates as follows:

Assuming it is in the fully latched position of FIG. 2, to open it the controller 26 energizes the motor 9 to rotate the wheel 11 in the direction $F_S$. This causes the cam surface 13 to push out the actuating pin 15 until it disengages the tooth 20 from the abutment face 7, which frees the fork 1 to rotate in the direction $F_D$ into the open position of FIG. 4, allowing the bolt 8 to pull completely out of the housing 4.

In this position, the edge surface 18 of the fork 1 is radially engaged with the pawl 2 and holds it and its pin 15 in the outer freeing position. This condition continues until the bolt 8 reenters the latch. In the open position the pin 15 will radially engage the face 17 of the tooth 23 of the wheel 11 when same rotates somewhat further and will block rotation of this wheel 11, causing current consumption of the motor 9 to spike. The controller will shut down the motor 9.

Thereafter once the bolt 8 is pushed back into the notch 21, it will pivot the fork 1 against the direction $F_D$ and move the fork edge 18 out of engagement with the tooth 20, allowing the pawl 2 to move back inward and assume the partially and fully locked positions of FIGS. 1 and 2, so that the cycle can be repeated. By this time, of course, the motor 9 will have been shut down, so that the cycle is simply triggered by starting the motor 9.

The electrical drive constituted by the controller 26 and motor 9 of this latch is therefore very simple. It need merely be triggered to energize the motor 9, and thereafter the unlatching and opening movements will all take place without any necessity of providing any monitoring switches or the like, since the end position is signaled by the current consumption of the motor 9 that is in fact fed by the controller 26.

We claim:

1. A motor-vehicle door latch comprising:

a housing;

a fork pivotal on the housing between a bolt-retaining closed position and a bolt-releasing open position;

a pawl pivotal on the housing between a blocking position engaging the fork and retaining it in the closed position and a freeing position allowing the fork to move into the open position;

a wheel rotatable about a wheel axis and having a radially directed cam surface engageable with the pawl, the surface of the wheel being spiral shaped and having relative to the wheel axis a radially high end and a radially low end separated by an angularly directed step face;

drive means for rotating the wheel and thereby engaging the surface with the pawl to displace the pawl into its freeing position; and means including interengaging blocking formations on the pawl and on the wheel contacting each other and blocking rotation of the wheel when the high end of the wheel surface is operatively bearing on the pawl for blocking rotation of the wheel when the pawl is in the freeing position.

2. The motor-vehicle door latch defined in claim 1, further comprising interengaging holding formations on the pawl and fork for holding the pawl in the freeing position when the fork is in the open position.

3. The motor-vehicle door latch defined in claim 1 wherein, relative to the wheel axis, the interengaging blocking formation of the wheel is an angularly directed blocking face fixed relative to, spaced angularly from, and directed angularly opposite to the step face.

4. The motor-vehicle door latch defined in claim 3, wherein the drive means includes a motor for rotating the wheel the wheel axis only in one rotation direction, the step face facing backward in the rotation direction.

5. The motor-vehicle door latch defined in claim 3 wherein, relative to the wheel axis, the wheel surface is a radially outwardly directed inner surface, the wheel having offset from the blocking face a radially inwardly directed outer edge surface that is generally circular and centered on the center of rotation of the wheel.

6. The motor-vehicle door latch defined in claim 1 wherein the drive means includes a motor for rotating the wheel in only one direction.

7. The motor-vehicle door latch defined in claim 1, further comprising a spring urging the pawl radially of the wheel axis inward against the wheel surface.

8. The motor-vehicle door latch defined in claim 7 wherein the pawl has a coupling pin projecting generally parallel to the wheel axis and normally riding on the wheel surface.

9. The motor-vehicle door latch defined in claim 1, further comprising a spring urging the fork into the open position.

10. A motor-vehicle door latch comprising:

a housing;

a fork pivotal on the housing between a bolt-retaining closed position and a bolt-releasing open position;

a pawl pivotal on the housing about a pawl axis between a radially inner blocking position engaging the fork and retaining it in the closed position and a radially outer freeing position allowing the fork to move into the open position;

a wheel rotatable about a wheel axis and having a radially outwardly directed cam surface engageable with the pawl and having a radially high end and a radially low end;

spring means urging the pawl radially inward toward the blocking position and into engagement with the wheel cam surface;

drive means for rotating the wheel in only one direction so as to move engagement of the pawl from the surface low end toward the surface high end and thereby displace the pawl into its freeing position;

means including a blocking face on the wheel engageable with the pawl for blocking rotation of the wheel when the high end of the wheel surface is operatively bearing on the pawl and the pawl is in the freeing position; and interengaging holding formations on the pawl and fork for holding the pawl in the freeing position when the fork is in the open position.

* * * * *